US009311770B2

(12) United States Patent
Ryan

(10) Patent No.: US 9,311,770 B2
(45) Date of Patent: Apr. 12, 2016

(54) PLAYER CONTROLS

(76) Inventor: Phillip James Ryan, Sydney (AU)

( * ) Notice: Subject to any disclaimer, the term of this patent is extended or adjusted under 35 U.S.C. 154(b) by 122 days.

(21) Appl. No.: 13/506,254

(22) Filed: Apr. 6, 2012

(65) Prior Publication Data

US 2012/0258795 A1 Oct. 11, 2012

Related U.S. Application Data

(63) Continuation-in-part of application No. 11/587,666, filed as application No. PCT/AU2005/000502 on Apr. 7, 2005, now abandoned.

(30) Foreign Application Priority Data

Apr. 7, 2004 (AU) ..... 2004901841

(51) Int. Cl.
*G07F 17/32* (2006.01)

(52) U.S. Cl.
CPC ..... *G07F 17/3206* (2013.01); *G07F 17/3237* (2013.01); *G07F 17/3239* (2013.01)

(58) Field of Classification Search
CPC ..... G07F 17/3206; G07F 17/3237; G07F 17/3239
USPC ..... 463/25, 29
See application file for complete search history.

(56) References Cited

U.S. PATENT DOCUMENTS 6,353,889 B1 * 3/2002 Hollingshead ..... 713/169
6,581,122 B1 * 6/2003 Sarat ..... 710/301
6,612,928 B1 * 9/2003 Bradford et al. ..... 463/29
6,629,890 B2 * 10/2003 Johnson ..... 463/25
6,645,075 B1 * 11/2003 Gatto et al. ..... 463/25
2003/0005337 A1 * 1/2003 Poo ..... G06F 21/32 726/5
2003/0022719 A1 * 1/2003 Donald et al. ..... 463/42
2003/0031321 A1 * 2/2003 Mages ..... G06Q 20/32 380/270
2004/0044897 A1 * 3/2004 Lim ..... 713/186
2004/0121841 A1 * 6/2004 Xidos et al. ..... 463/40

* cited by examiner

*Primary Examiner* — David L Lewis
*Assistant Examiner* — Shauna-Kay Hall

(57) ABSTRACT

The patent involves the use of a portable device with a universal serial bus connector and memory which can store the unique biometrics of its registered owner for the purposes of identification; record the biometrics of any person attempting to use the device; confirm whether the user is the registered owner of the device; control access to electronic devices; monitor and record the operational activity of its user; store pre-defined value, duration and budgetary constraints; compare activity to pre-defined values, durations and budgetary constraints; store monetary value; visually indicate when operative; be electronically locked and de-activated; and connect and communicate directly or remotely to other electronic devices.

The device can be used for example in the identification and elimination of problem gamblers from gambling devices/services while either physically present at a gambling venue or through remote access via the internet, interactive television, intranets, extranets, telephones or other digital communication services.

19 Claims, 5 Drawing Sheets

PLAYER CONTROLS

The invention is a continuation-in-part of U.S. patent application Ser. No. 11/587,666, which was the US national phase of International Patent Application No PCT/AU2005/000502, filed 7 Apr. 2005, which claims priority from Australian provisional application No 2004901841 filed 7 Apr. 2004, the entire content of all the above-mentioned applications being hereby incorporated by reference.

TECHNICAL FIELD

This invention relates to a portable device for enabling access to and regulation of gambling. The invention is particularly suited to the identification and elimination of problem gamblers from gaining personal access to electronic gaming machines and other gambling devices or services whilst either physically present at a gambling venue or through their remote access to a gambling venue or gambling service via the internet, interactive television, intranets, extranets, telephones or other digital communication services.

BACKGROUND TO THE INVENTION

Electronic gaming machines (sometimes referred to as poker machines or slot machines) have grown in popularity across the globe in recent decades. Their increasing popularity has also led to a significant rise in problem gambling being experienced by a rising percentage of gamblers. In Australia, for instance, over one third of all player losses on poker machines is estimated to come from problem gamblers (Productivity Commission Report on Gambling).

Governments have attempted to restrict problem gambling by restricting the environments of electronic gaming rooms (via lighting controls, the installation of clock displays, displaying of problem gambling advice notices, initiating smoking restrictions in gaming rooms etc) and by restricting the machines themselves (limiting the number of machines, limiting the denomination of bank notes accepted by the machines, slowing machine game rates and creating maximum bet limits on a single wager etc).

Unfortunately most measures introduced to date have been broad-brush approaches that have failed to reduce the incidence of problem gambling amongst poker machine players and have primarily resulted in severely limiting the playing experience of genuine recreational players.

The difficulty for the operators of poker machine venues and poker machine networks is that it is virtually impossible to detect a problem gambler from pure external observations (compared to the relative ease of detecting a person inebriated from alcohol or under the influence of drugs in the very same licensed venue).

Even once detected by a venue, a problem gambler can very easily move from venue to venue on a daily basis across a wide geographic region so as to avoid any further detection, and continue their habitual behaviour.

Access to Other Forms of Gambling

Problem gamblers can also gain relatively easy and virtually anonymous access to a wide and growing range of alternative electronic gambling venues via the internet, interactive televisions linked to homes and businesses via cable or satellite, mobile telephone, direct computer linkages to gambling venues via ISDN, the internet and other means of telecommunication connection, any or all of which also place the personal financial resources of such gamblers at high risk.

The detection of problem gamblers and their elimination from gaining access to gambling venues, gambling devices and gambling services are overcome by this proposed technical solution, which restricts access to poker machines, internet gambling sites, mobile telephone, direct computer linkages to gambling venues, and interactive televisions for the purposes of gambling, and through other mediums defined later, to only those players who are genuine recreational players, and thereby completely disallowing access to identified problem gamblers.

SUMMARY OF THE INVENTION

A portable device is provided to enable access to and regulation of gambling, the portable device comprising:

a universal serial bus (USB) connector configured to operatively couple with an input/output port of a remote device via which a user intends to gamble;

a biometric reader operable to validate a biometric authentication input of a user based on a stored authentication value;

a memory component;

a processor, in communication with the memory component, the biometric reader and the USB connector, the processor operable when the authentication input validates successfully to:

execute code to determine whether the user is prohibited from gambling; and when the user is not prohibited from gambling to:

execute code to enable access to gambling via an interface of the remote device, to compare real-time gambling behaviour of the user against a stored profile for the user; and to prevent the user from any further access to gambling via the or any other interface should the gambling behaviour of the player exceed that specified by the user's stored profile.

The authentication value may be stored remotely from the portable device or stored to memory in the device's memory component.

The input/output port of the remote device may be a USB port of a gambling machine. Optionally the input/output port of the remote device may be a USB port of one of a computer, mobile phone, smart phone, personal organizer and television which is wirelessly connectable to a host server to enable access to gambling.

The biometric authentication input may be a scan of a fingerprint or an iris scan.

The user's stored profile may include a maximum allowable loss within a specified period of play or a maximum amount wagered within a specified period of play. The period of play may be continuous.

The user's profile may be stored remote from the portable device or stored to memory in the device's memory component.

The gambling behaviour of the user may include one or more of gambling wagers, an amount won, an amount lost, a number of games played and a period of play for each bet wagered.

Digital certificates may be stored to the memory component and the processor is further operable to encrypt data transferred via the USB connector.

The processor may be further operable to execute code, when the user is prohibited from gambling to execute code, to prevent access to any further gambling for a defined period time.

A method is provided to enable access to and to regulate gambling, the method comprising:

validating a biometric authentication input of a user based on a stored authentication value, and when the authentication input validates successfully determining whether the user is prohibited from gambling, when the user is determined not to be prohibited from gambling enabling access to gambling via an interface to which a USB connector of a portable device is connected;

comparing real-time gambling behaviour of the user against that user's stored profile; and preventing further gambling to the user via the interface should the gambling behaviour of the player exceed that specified by the user's stored profile.

A system is provided to enable access to and to regulate on-line gambling, the system comprising:

a gambling server operable under program control to facilitate regulation of on-line gambling, the gambling server in communication with one or more external servers each associated with an accredited gaming facility;

a master portal communicable with the gaming server by means of a communication network and further communicable with one or more remote computing devices on which registered users are able to access to at least some of the accredited gaming facilities in order to gamble, where said remote computing devices are operable to communicate with a biometric enabled portable device to enable a registered user of said biometric enabled portable device to access gambling; and a database server in communication with the gambling server, the database server storing gambling behaviour information associated with registered users;

wherein on receiving notification of a valid biometric authentication input a selected external server which is associated with an accredited gaming facility grants access to the associated registered user and said selected external server is operable to transmit data indicative of a summary of said registered user's gambling behaviour to at least one of said database server and to a memory of said biometric enabled portable device of said registered user.

The biometric enabled portable device may comprise:

a universal serial bus (USB) connector configured to operatively couple with an input/output port of a remote device;

a biometric reader configured to validate a biometric authentication input of a registered user based on a stored authentication value;

a memory component;

a processor, in communication with the memory component, the biometric reader and the USB connector, the processor operable when the authentication input validates successfully to: execute code to determine whether the registered user is prohibited from gambling; and when the user is not prohibited from gambling to: execute code to enable access to gambling via an interface of the remote device, to compare real-time gambling behaviour of the user against a stored profile for the registered user; and to prevent the registered user from any further access to gambling via the or any other interface should the gambling behaviour of the player exceed that specified by the registered user's stored profile.

The communication network may be the Internet and the master portal may be a website on the World Wide Web of the Internet.

As discussed above, the authentication value may be stored remotely from the portable device or stored to memory in the device's memory component. In the case in which the authentication value is stored remotely from the portable device, it may be stored on the database server. Similarly, the user's profile may be stored remote from the portable device on the database server or stored to memory in the device's memory component. The user's stored profile may include a maximum allowable loss within a specified period of play or a maximum amount wagered within a specified period of play. The period of play may be continuous. The gambling behaviour of the user may include one or more of gambling wagers, an amount won, an amount lost, a number of games played and a period of play for each bet wagered.

BRIEF DESCRIPTION OF THE DRAWINGS

Examples of the invention will now be described with reference to the accompanying drawings in which.

DESCRIPTION OF THE PREFERRED EMBODIMENTS

Figure 1:
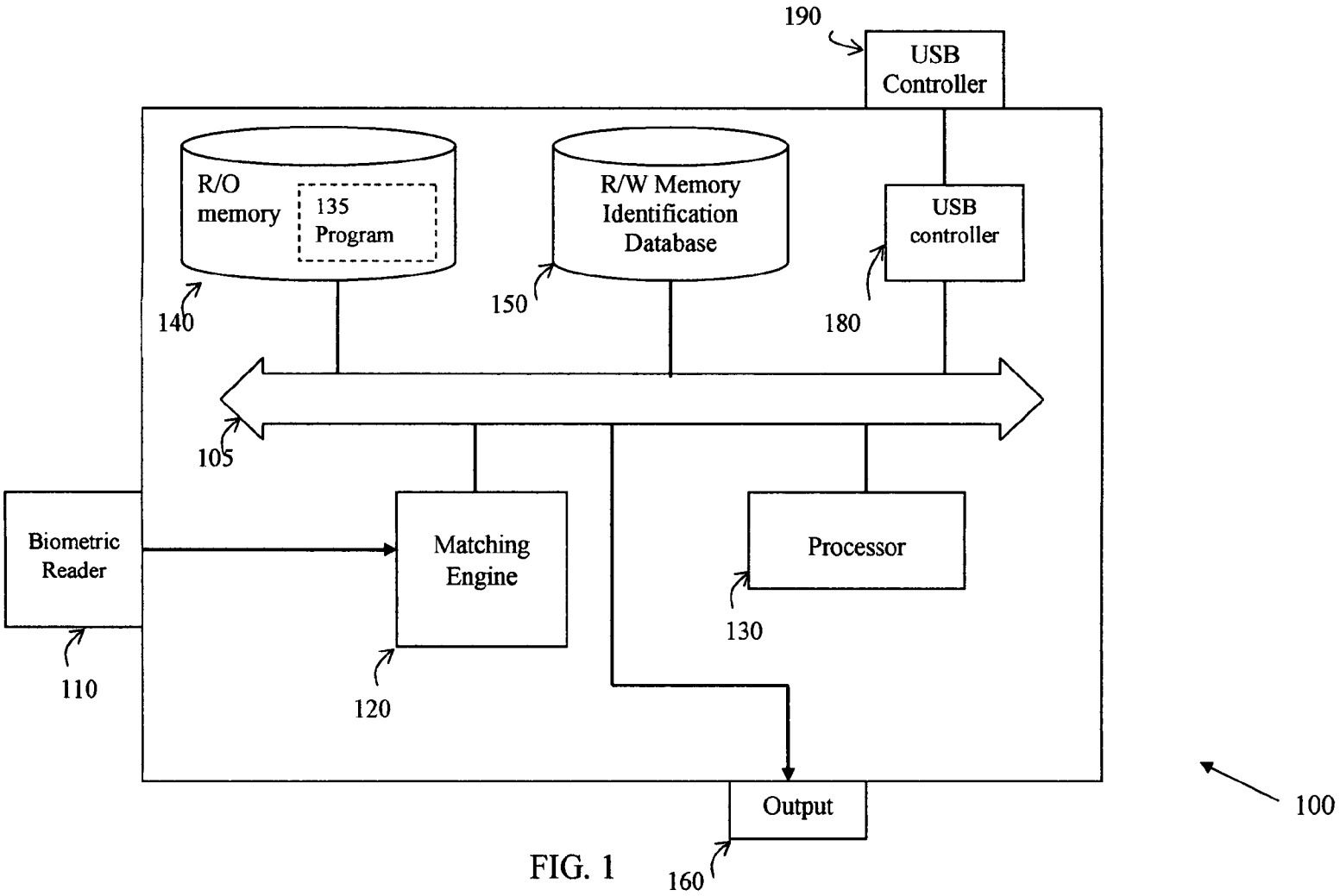
FIG. 1 is a schematic diagram of a portable device in accordance with an embodiment of the invention.

In order that the invention may be more clearly understood and put into practical effect there shall now be described in detail, preferred embodiments of a portable device and player control system in accordance with the invention. FIG. 1 is a block diagram illustrating components of a portable device 100 according to one embodiment of the invention. Portable device 100 includes communication bus 105, biometric reader 110 coupled to a biometric matching engine 120 (the latter which is coupled to bus 105) and biometric program 135 stored in read-only memory 140 which is also coupled to bus 105. Portable device 100 further includes a processor 130, read-write memory 150, output 160, USB controller 180 and USB connector 190. Processor 130, read-only memory 140, read-write memory 150, output 160 and USB controller 180 are also coupled to bus 105. USB controller 180 is also coupled to USB connector 190. Processor 130 is communicately coupled to read/write memory 150 on which is stored instructions for performing the operations required to implement certain functionality of the portable device 100.

Read write memory 150 and USB controller 180 enable portable device 100 to serve as a conventional memory stick. Read write memory 150 may be flash memory.

The biometric reader 110 is in the form of a fingerprint reader. Fingerprint reader is mounted on an exterior of the device's housing to collect biometric data from the user when the user is holding the portable device 100. The matching engine 120 includes built-in processing to reduce the biometric data to data suitable for use to perform matching against the record stored in the read only memory 140. The biometric reader 110 is sized and disposed to collect data from the user's thumbprint when the user grips the portable device 100 to insert it into a mobile telephone or host computer's I/O port or transmit it to a receiver of the mobile telephone or host computer. To facilitate measurement of the holder's fingerprint, the housing can be designed to cradle the user's thumb in a particular place.

During a setup phase, biometric program 135 is operative to prompt the user to provide a biometric reference sample, such as fingerprint or thumbprint scan, and to associate the reference sample with the user. This reference sample of the user is in the form of a biometric template for the registered user and is referred to as the stored authentication value. The biometric template is a mathematical representation of the user's biometric data or a copy of the user's fingerprint.

During an operation phase, biometric program 135 is operative to control access to the functions of the portable device 100 by requiring the user to provide a biometric sample (authentication input). The authentication input is passed to the matching engine 120 which then compares the authentication input with the biometric reference sample (authentication value) stored in the read only memory, to detect if the user is authorized. The matching engine 120 produces a result to the processor 130 indicating whether the user's identity has been authenticated. The result may be displayed by the output 160 taking the form of an LCD display, audio device, colour indicator etc.

After the user is authenticated the processor 130 looks up the user's profile information stored to the flash memory 150. The profile information includes information associated with that player's playing characteristics, namely a maximum allowable loss within a specified period of play, a value for the specified period of play, an indication of whether the specified period of play is continuous play, a maximum amount wagered within a specified period of play. On the condition that the user is not prohibited from gambling or the user has not exceed self imposed limits or government limits defined by the profile information, access to gambling is granted.

The matching engine 120 and the processor 130 are software, hardware, and/or firmware, such as, for example, application specific integrated circuit (ASIC), modules for respectively verifying a user's identity and releasing an information profile of the user if the user is verified.

Electronic Gaming Machines

The first example of use of the portable device 100 relates to electronic gaming machines operating as a network of centrally monitored machines in a defined geographic region.

The USB Access Key

Player access control is achieved by requiring all prospective players to be issued with a uniquely identifiable, personal and portable Universal Serial Bus (USB) storage device 100 with flash memory or its equivalent (hereafter referred to as a USB Access Key), which can communicate directly or remotely to a USB port of a gaming machine or to a USB port of a centrally monitored electronic box connected to each gaming machine or gambling device, and to have all of each player's playing activities recorded on a central monitoring computer (in one variant of the invention) or on their personal USB Access Key (for a second variant of the invention) or on both their personal USB Access Key and a central monitoring computer (for a third variant of the invention) for all games played on all poker machines in all the gaming venues being monitored in a geographic region.

Initial Player Registration/Enrolment

Figure 2:
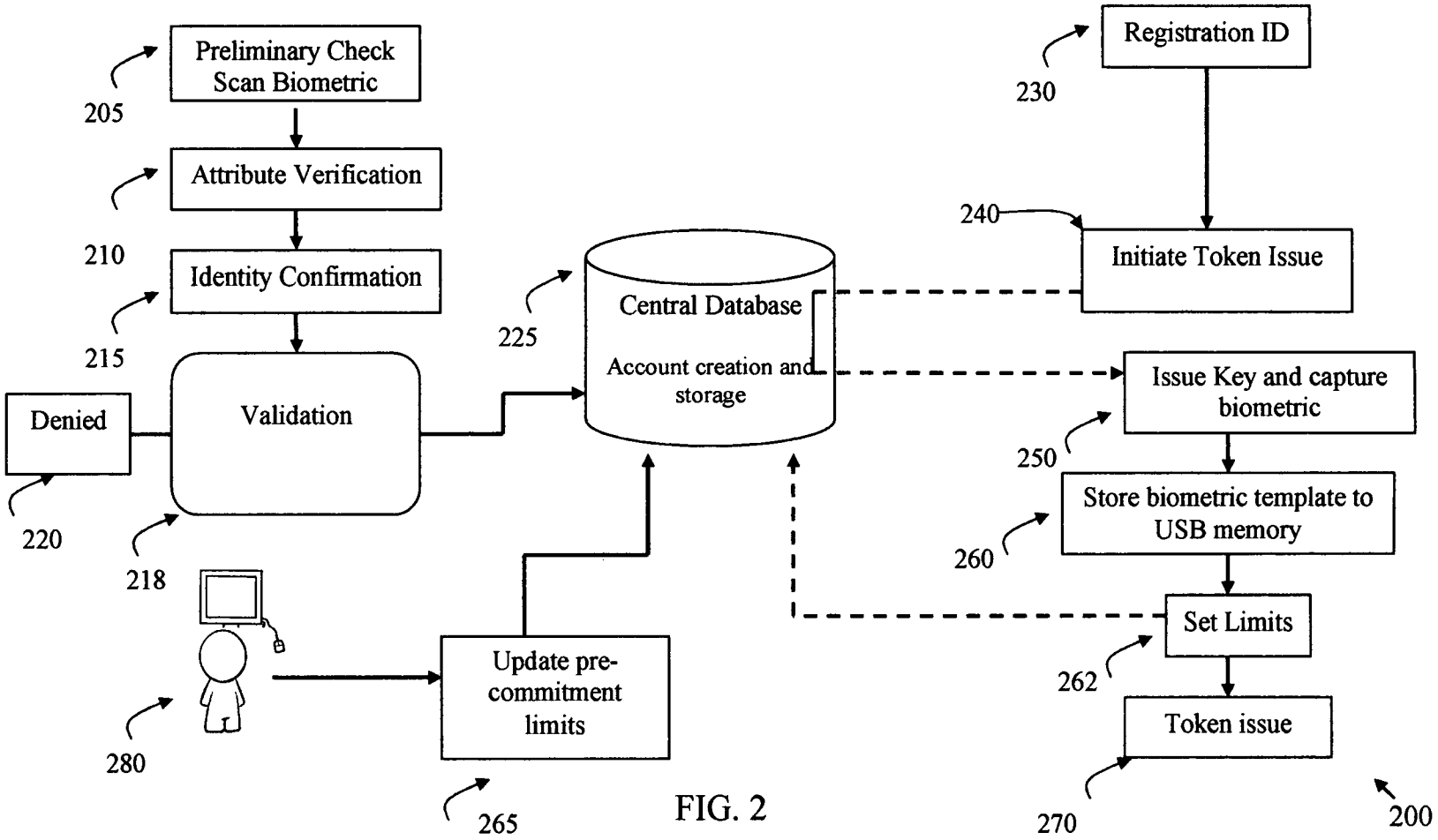
FIG. 2 is a flow diagram showing player enrolment/registration.

With reference to FIG. 2, at initial mandatory player registration/enrolment, each person wishing to gain access to gambling services as a player will be required to undergo an enrolment procedure 200. Enrolment may be effected online, or in person at a government accredited facility. Initially, a preliminary step is carried out whereby the person presenting themselves for enrolment has their biometric scanned 205. A preliminary check is then performed to ensure that said person has not already been issued with a USB access key 100. Thereafter, each person's attributes are verified 210, in that each person will be required to present personal credentials confirming their true identity at a standard equivalent to that required at the time by the major banks in Australia (or the country of deployment) for customers wishing to establish their first account with a bank. Once their identity is confirmed 215, an enrolment duplication check is undertaken to check for the existence of identity fraud. Enrolment duplication may be carried out externally 218 in which case relevant data may be dispatched to the regional police department or other external authenticity authority. On detection of identity fraud or identity duplication the person concern will be denied registration 220. Otherwise a customer account is established and stored to a central database 225. The unique customer account contains information pertaining to their name, address, contact details. In the situation where the customer is enrolling online, the customer is issued with a unique registration identifier which can then be used to receive a uniquely identifiable USB Access Key 100.

To receive their USB Access Key the customer presents themselves at a government accredited facility, such as a post office. The customer presents their registration identifier 230 which starts the token initiation process 240. The registration identifier is verified against the central database 225 to ensure that a non authorised party has not fraudulently used the identifier to obtain the Key. In the instance that the registration identifier is verified a USB Access Key is issued to the customer 250.

As part of the token initiation process 240, a customer account is established which may contain the user's name, address, contact details, any other necessary details and agreement to be contacted by professional problem gamblers if they start exhibiting potential problem gambler player characteristics. In addition a biometric identifier of the user is captured 250 and stored 260 to the read only memory 140 in the USB Access Key in accordance with the setup phase briefly described above.

During this registration process, all players will be given the opportunity to define their own pre-defined maximum daily and/or weekly and/or monthly and/or annual limits on gambling losses and duration of play 262. These limits are generally referred to as pre-commitment limits. Such limits may be stored to the central registry 225 (first variant of the invention), to the read write memory 150 of the Key (second variant of the invention), or to both of the central registry 225 and the read write memory 150 of the Key (third variant of the invention). The Key is then released to the user 270.

Once registered, a player 280 is able to update their pre-defined pre-commitment limits online. FIG. 2 schematically illustrates a player 280 updating their limits 265 online where their pre-commitment limits are stored to the central database 225.

Player Monitoring

Players are then monitored by recording every poker machine player's individual and collective gambling wagers, wins, losses, games played and durations of play for every one of their bets at every poker machine they play in the geographic region, and then comparing this data to their own pre-defined daily and weekly limits on gambling losses and duration of play, and by also comparing their play to publicly recognised limits on reasonable gambling losses and durations of play on a daily and/or weekly and/or monthly and/or annual basis (eg Productivity Commission definitions of problem gambling behaviours in Australia being losses exceeding around $12,000 per annum). In the absence of any publicly recognised limits being available, either direct market research will be undertaken across a representative sample of the adult population to determine acceptable limits of annual spend and gambling duration on poker machines, or the government controlled gambling authority will be asked to define or approve such a value.

Figure 3:
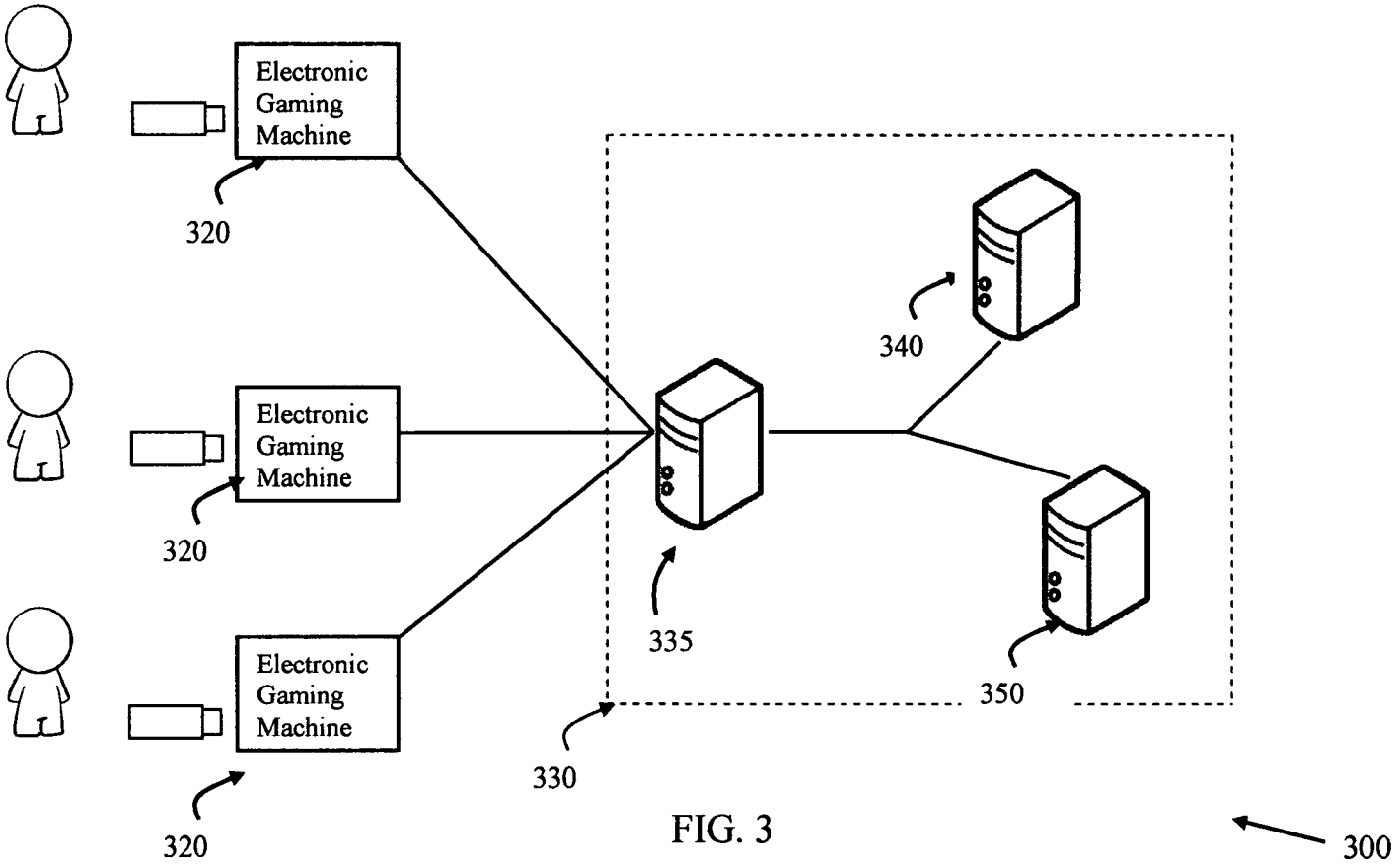
FIG. 3 is a schematic diagram of a gaming system using the portable device shown in FIG. 1.

FIG. 3 schematically illustrates a system 300 which enables such monitoring of electronic gaming machines 320 operating as a network of centrally monitored machines 330 in a defined geographic region. The network 330 includes a central server 335, an application server 340 and a central database server 350 on which is stored user pre-commitment limits. Central database server 350 operates to receive every poker machine player's individual and collective gambling wagers, wins, losses, games played and durations of play for every one of their bets at every poker machine 320 and comparing this data to their own pre-defined daily and weekly limits on gambling losses and duration of play stored in server 350. Application server 340 is dedicated to the efficient execution of procedures (programs, routines, scripts etc) for supporting the construction of applications which compares the real-time gambling against the user's stored profile.

Player Classification

Potential problem gamblers are those whose aggregate daily and/or weekly gambling losses and/or durations of play exceed their own limits set at initial player registration (or later updated by the player in a manner which is not beyond an agreed multiple of normal annual inflation or annual Consumer Price Indexes increases or which are regarded as acceptable by qualified and approving problem gambling counsellors) or exceed the limits publicly recognised as exhibiting problem gambling characteristics. Recreational players are those who do not exceed any such limits.

Storage of the Comparative Data

Both sets of data i.e. player pre-defined limits on losses and duration of play (and publicly recognised limits on reasonable gambling losses) and actual player losses and duration of play, are recorded against the player's profile on a central monitoring computer connected to every gaming machine (in one variant of the invention) and/or on the personal USB Access Key issued to every player (in second and third variants of the invention).

Collection of Playing Data

Actual player losses and durations of play are obtained by ensuring in order to activate any poker machine, a player must first confirm their true identity as the original owner of the USB Access Key, as discussed more extensively in the later section on Entry Control Variations. A central monitoring computer and/or the USB Access Key will then continuously record in a digital manner all player losses and durations of play from all machines and games played by the player, and aggregate this behavioural data over time in the designated storage facility.

Use of Problem Gambling Counsellors

If a player exceeds their own or any publicly recognised reasonable limits on losses or duration of play then they may be counselled by professional problem gambling counsellors and encouraged to modify their compulsive gambling behaviours. If this isn't successful then all such players upon advice from the professionally recognized counsellors will be completely restricted from playing poker machines until they can once again demonstrate reasonable gambling behaviours.

Enforcing Restrictions

These restrictions will be enforced at all gaming rooms in a specified geography, by requiring every player to present themselves and their personal USB Access Key at all gaming rooms and/or all gaming machines, prior to being given player access to any gaming machines in the venue.

Confirming Identity

It will be necessary to firstly confirm that the identity of the person presenting himself or herself is the same as the identity of the original USB Access Key owner. This will be done by applying one or more of a range of options available with the USB Access Key (from simple photo ID matching between the person and any photograph implanted on the face of, or in another variant stored digitally inside the USB Access Key device; to Personal Password matching the users proposed Password to the actual Password of the real owner stored on the USB Access Key; through to matching of the fingerprint profile or profiles (and other biometric characteristics in other variants of the invention) of the person presenting themselves to the gaming room venue or gaming machine with those of the real owner of the USB Access Key designated at a time of original player registration, which are stored digitally inside the USB Access Key).

Player Analysis to Allow Continued Play

Once player identification is confirmed, electronic analysis of the player's past playing activities will be analysed on the central monitoring computer (in one variant of the invention) and/or on the player's USB Access Key (in a second and third variant of the invention) and a determination made as to whether the player is actually a recreational player or a potential problem gambler by direct digital comparison of actual player losses and durations of play with those registered and stored in the USB Access Key and/or the central monitoring computer at original registration (or subsequently updated).

Only recreational players who are not exceeding both their own pre-defined and also the publicly accepted pre-defined limits on money losses to date and total duration of play to date will be allowed access to the gaming equipment in the gaming venue. All players exceeding either their own pre-defined limits or the publicly accepted limits will be excluded from gaining access to the gaming room or in the alternative denied access to any gaming equipment.

Voluntary Exclusion

Individual problem gamblers who voluntarily wish to be excluded from any or all gaming rooms or any or all gaming machines will be able to have their personal USB Access Keys pre-set for such arrangements.

Entry Control Variations

In a most basic alternative of the invention, in order for entry controls to be exerted at a single physical entrance to all gaming rooms it would be necessary for all gaming rooms to have floor to ceiling walls to exclude entry at all points other than their entrance. Players wishing to enter the gaming room would be required to match their identity to that stored on or by alternative within their USB Access Key. All authorised players wishing to leave a gaming room may also be required to match their identity characteristics to those stored on or in their personal USB Access Key at the same place as entry.

In another alternative, digital barriers to entry (as alternatives to physical barriers of entry) would be exercised whereby all prospective players would be required to match their fingerprint (or other biometric characteristics) to that stored on their personal USB Access Key at the time of original player registration, at a designated point at the gaming venue. Once confirmed as the true owner of the USB Access Key, their USB Access Key would be digitally activated to allow the owner to have access to all gaming equipment and gambling facilities in that venue for the duration of their current visit or for a pre-defined and specified duration. Those people, whose fingerprint(s) (or other biometric characteristics) did not match those on the USB Access Key they present, would not have their USB Access Keys digitally activated for access to any gaming equipment at the venue for a pre-defined duration.

In a more intensive alternative at the micro level, all players would present themselves at a gaming machine. They would insert their USB Access Key into the gaming machine and the USB Access Key would require the person inserting the device to confirm that their fingerprint(s) (or other designated biometric characteristics) are the same as those stored on the USB Access Key by the original owner of the USB Access Key at the time of original registration of the player and the device. If a correct match occurs then the player is allowed access to the gaming machine and his/her gambling behaviours (i.e. money lost and won, wagered and duration of play on every game etc) will be monitored and stored on the USB Access Key itself if the gaming machine is not being centrally monitored, or stored on the USB Access Key itself and/or at a central monitoring facility if the gaming machine is being centrally monitored.

Protection of Access Keys

The USB Access Key would be programmed to terminate play for players who are inactive in their gambling for a defined period of time, or for uncharacteristic playing behaviour in terms of either wagers, losses or duration of play, and would only be restarted by further re-confirmation of the identity of the original owner. This will eliminate risks of USB Access Keys being left in devices and used by other players.

Application to Alternative Forms of Gambling

With respect to Internet, intranet and extranet gambling sites, interactive television gambling channels and services, and other directly connected gambling devices activated by the player through other telecommunication services (e.g. WAPP, SMS, ISDN, mobile telephone, GPRS, 3G, 2.5G, satellite, cable, microwave, electronic photons, lightwaves etc) the player would similarly be initially registered with associated collection of their personal details and agreements at standards equivalent to those outlined in the electronic gaming example.

Registered players would then be required to insert their personal USB Access Key into the physical device or its associated equipment connecting the device to the player and the service provider (e.g. via their television, television set top box, pay television subscriber box, Personal Digital Organiser, mobile telephone, Smartphone, telephone, laptop computer, or desktop computer etc) firstly confirming that the fingerprints (or other designated biometrics) of the requesting user is/are in fact the fingerprints (or other biometrics) of the original owner of the original USB Access Key at the time of original player registration and allocation of the USB Access Key.

Once confirmed as the original owner of the USB Access Key, the players' devices would be programmed to allow the user continued access to the gambling facility or its gambling services whilst their accumulated player behaviours are within their own limits or publicly accepted limits of recreational gamblers. The USB Access Key would be programmed to accumulate the gambling behaviours of the player (both in terms of money spent and money won and money lost) as the player is connected to the gambling service remotely. If limits are exceeded and problem gambling counsellors are not able to be satisfied that the registered player is a recreational gambler and not a problem gambler, then the player's USB Access Key will be locked to disallow them any further access to the gambling service until their player behaviours are satisfactorily modified to a level of satisfaction agreed to by their counsellors.

Single Provider Usage Versus Holistic Usage

The USB Access Key could be unique to each individual gambling service provider or could be programmed by multiple gambling provider cooperation or government regulation, to accumulate the player behaviours of a single player on a single USB Access Key that is used across all agreed or approved gambling venues or service providers (including gaming, wagering, lotteries etc).

Extended Uses of the USB Access Key

The USB Access Key may have the storage capacity and technical capabilities to store digital currency in an electronic purse which is transferred to the device by a player's financial institution or other currency provider in order to allow cashless gaming. In cashless gaming the digital currency may be used to wager and thereby depleted in value, and/or have any winnings accumulated to its value whilst engaged in gambling.

The USB Access Key would also have the ability to be activated for remote USB connectivity or Radio Frequency Identification (RFID) of the player for a pre-defined period of time once the player's identity has been confirmed as the original owner of the USB Access Key. Once identity is confirmed, gambling access is achieved by ensuring the USB Access Key contained a single unique piece or group of binary digits of information to indicate the owner's presence via remote USB transmission or via radio frequency transmission through an RFID reader which can detect the transmission of the unique ID binary digits during a pre-defined period of time. The player can then simply swipe their USB Access Key in the vicinity of the device used for gambling services and have their gambling behaviours collected remotely or via radio frequency transmission Advantages of the USB Access Key The use of a Universal Serial Bus storage device as a personal USB Access Key offers many significant advancements and advantages for players and providers of gambling facilities and services.

The major advantage of USB devices is that connection plugs for Universal Serial Bus devices are now ubiquitous on desktop computers and laptop computers, and are provided as standard equipment on such devices.

Those devices not currently providing USB access can be converted to USB status very quickly and very cheaply due to the open structure standard environment created for USB devices globally.

USB storage devices with biometric fingerprint ownership confirmation are now being commercially provided by a range of manufacturers such as Sony in Japan with their Sony Puppy and from PlexusCom in Taiwan with their BioDisk Biometric Flash Disk.

USB storage devices also offer cost and access advantages as well as greater storage capacity (currently at levels around 32 Gigabyte) over other devices such as smartcard devices which are not automatically provided as standard equipment with desktop computers, laptop computers, and other technological devices; require the additional expense of specific smartcard readers; and are very limited in their storage capacities.

USB devices will also store all types of files such as text files, graphics, programs, music and multi-media, which make them very versatile to changing customer needs and environments, including the direct downloading of a player's favourite games. Typical USB storage devices will currently operate at over one million insertions and removals of the unit into and out of electronic devices and their memories last at least 10 years.

Interface of the USB Access Key with Current Loyalty Programs

Another advantage of the USB Access Key is that it offers an increased level of sophistication (i.e. unique player identification and authentication) over current player loyalty programs, but can still simply interface with all such loyalty programs whether they utilise magnetised cards or smart-cards. In other words such loyalty programs can co-exist with this invention providing the added value of confirming player identity.

Current loyalty providers will not be required to convert to a new uniform standard of equipment which forces them to change their current investments in both past hardware and software development. All that is required is for the loyalty program providers to gain initialised upfront confirmation of the owner's true identity via this USB Access Key prior to activating their unique loyalty program hardware and software services for the player.

Internet GAMING

The USB Access Key lends itself to resolving the user identity issues confronted by governments currently reluctant to allow their citizens to gamble on digital superhighways.

Currently U.S. law prohibits Internet wagering. U.S. government officials defend their laws saying on-line gambling is dangerous because it cannot prevent under-aged wagering. This identity problem is resolved through use of the digital USB Access Key, which can immediately identify the bona fides of all on-line gamblers.

The current prohibitions by governments are not sustainable in the long term because their current bans on domestic internet gambling are only encouraging their citizens to gamble with overseas internet and wagering services, which pay no taxes to the local domestic government.

Worldwide there are now an estimated 2,200 on-line gambling sites. Global Internet gambling increased from around AU$3 billion in 2000, to around AU$6 billion in 2002, with revenues forecast to reach AU$18 billion in 2006.

In light of increasing iGaming usage and an inability to capture taxation revenues from overseas gambling providers, national and state governments will need technologies that provide confirmation of player identity (to ensure under age gamblers are restricted), combined with capabilities to restrict domestic players to interface with only their local domestic gambling providers (in order to capture full taxation benefits), ideally overlaid with technology that detects and restricts any growth in the incidence of problem gambling.

The USB Access Key in accordance with the invention provides instant laptop and PC connectivity for over 1 billion computer users with USB connectivity (i.e. users do not need to purchase additional magnetic or smartcard readers).

USB connectivity is also currently being deployed for Personal Digital Assistants (PDAs) and shortly to global mobile telephones.

Deployment of a iGaming solution to a country such as Australia would involve the creation of a specific single gambling portal site which would be a government mandated accessible entry gate available to online gambling for Australians. This site would provide links to all government accredited gaming, wagering, sports betting, lottery and other approved gambling providers licensed, regulated and taxed in Australia.

Figure 4:
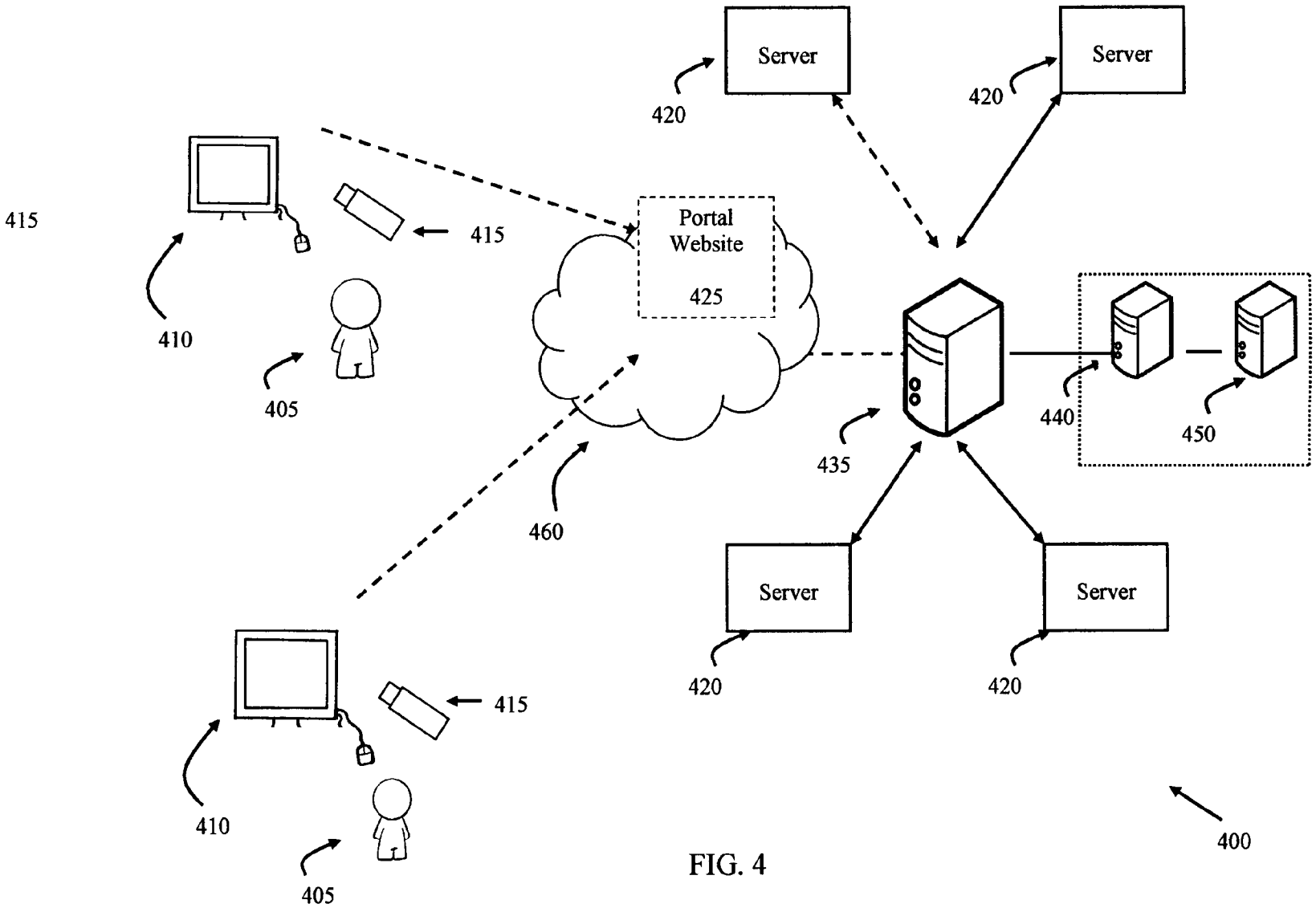
FIG. 4 is a schematic diagram of a further gaming system using the portable device shown in FIG. 1.

FIG. 4 illustrates a generalised block diagram of a system 400 suitable for the deployment of iGaming in Australia, in accordance with an exemplary embodiment of the invention. It is understood that the diagram of FIG. 4 is intended to be illustrative, and that the system 400 may have a large number of computing devices, including a plurality of web servers, application servers, database servers, and terminals, which are all connected in many different and complex configurations over a plurality of communication channels.

System 400 includes a plurality of client terminals or remote computing devices 410 which include, without limitation, desktop computer, a laptop, a workstation, mobile phones, personal data assistants (PDAs) etc, one or more administration servers 420 each associated with an accredited gaming facility, a portal web site 425 managed by web server 435 and associated with an application server 440 and a database server 450. The computing devices 410 transmit and receive gaming information to and from communications network 460. Gaming information is also transmitted between network 460 and one or more administration servers 420 each associated with an accredited gaming facility, such as a casino.

Software resides on the USB access key 415, which communicates with a gaming communication device 410, and/or is installed on computing device 410, and the one or more administration servers 420. Software resident on USB access key 415 is operable to present information corresponding to gaming activities to the user and to limit and control access to gaming subject to the user's gambling behaviour. Software resident on the USB access key 415 and the one or more administration servers 420 is able to exchange data with the database server 450 associated with government authorities and perform functions common to known electronic gaming systems.

Gaming information transmitted across network 460 may include any information, in any format, which is necessary or desirable in the operation of the gaming experience in which the user participates. The information may be transmitted in whole, or in combination, in any format including digital or analog, text or voice, and according to any known or future transport technologies, which may include, for example, wireline or wireless technologies. Wireless technologies may include, for example, licensed or license-exempt technologies. Some specific technologies which may be used include, without limitation, Code Division Multiple Access (CDMA), Global System for Mobile Communication (GSM), General Packet Radio Service (GPRS), WiFi (802.11x), WiMax (802.16x), Public Switched Telephone Network (PSTN), Digital Subscriber Line (DSL), Integrated Services Digital Network (ISDN), or cable modem technologies. In essence the communication network 460 can be any type of network, such as the Internet, a local area network (LAN), a wide area network $(WAN)_3$ a virtual private network (VPN), a wireless network, and the like. In certain exemplary embodiments of the invention the remote user 405 can access the portal web site 425 using a modem or a router or a switch. These are examples only and one of ordinary skill will understand that other types of communication techniques are within the scope of the present invention. Further, it will be understood that additional components may be used in the communication of information between the users and the gaming server. Such additional components may include, without limitation, lines, trunks, antennas, switches, cables, transmitters, receivers, computers, routers, servers, fiber optical transmission equipment, repeaters, amplifiers, etc.

A player 405 using a client computing device 410 connects through a communication network 460 to the portal web site 425 maintained by web server 435. The web server 435 is not necessarily a single or stand-alone computer and may be distributed among several different computers running one or more applications.

Australian Internet users wishing to gamble would log onto this master portal site 425, activate their biometric USB device 415 on their PC or computing device 410 by confirming their fingerprint identity, and then would be allowed to gamble with all gambling providers 420 in any manner designated and permitted by each individual gambling service provider 420 and their associated state regulator.

Access to the portal interface 425 would be managed by a government accredited supplier (to ensure user identity matching criteria interfaces are activated and confirmed), and each gambling service provider accessible from the master portal would be required to provide the supplier with a summary of each gambling session by each player (e.g. duration of gambling, amount wagered, amount won or lost) which would be stored to the player's USB device or associated server during or at the conclusion of each gambling session. The government accredited supplier would securely manage the transfer of information between the users and the gambling service providers and manage the master port 425 using the application server 440 and the database server 450.

By being able to identify on line gamblers and ensure that only recreational gamblers are gambling, this internet Gaming solution allows expansion growth in the range of internet gambling activities hitherto banned due to their previously perceived potential of increasing problem gambling and underage gambling.

Specifically the solution would allow for the introduction of:

On line Casino gambling for Australians,

On line poker machine betting for Australians

On line ball-by-ball betting after the commencement of a sporting event for Australians In-the-run betting on the final outcome of a sporting event after commencement.

Such control mechanisms would allow for the creation of a viable on-line casino and expanded sports betting model for Australian citizens, corporations and governments. It is already known that the dominant forms of interactive gambling across the globe are currently internet casino gaming and sports betting, which together constitute 85% of on line gambling revenue, and 93% of internet gambling activity.

This solution is also transportable to other global jurisdictions.

Central Repository for Key Management

Figure 5:
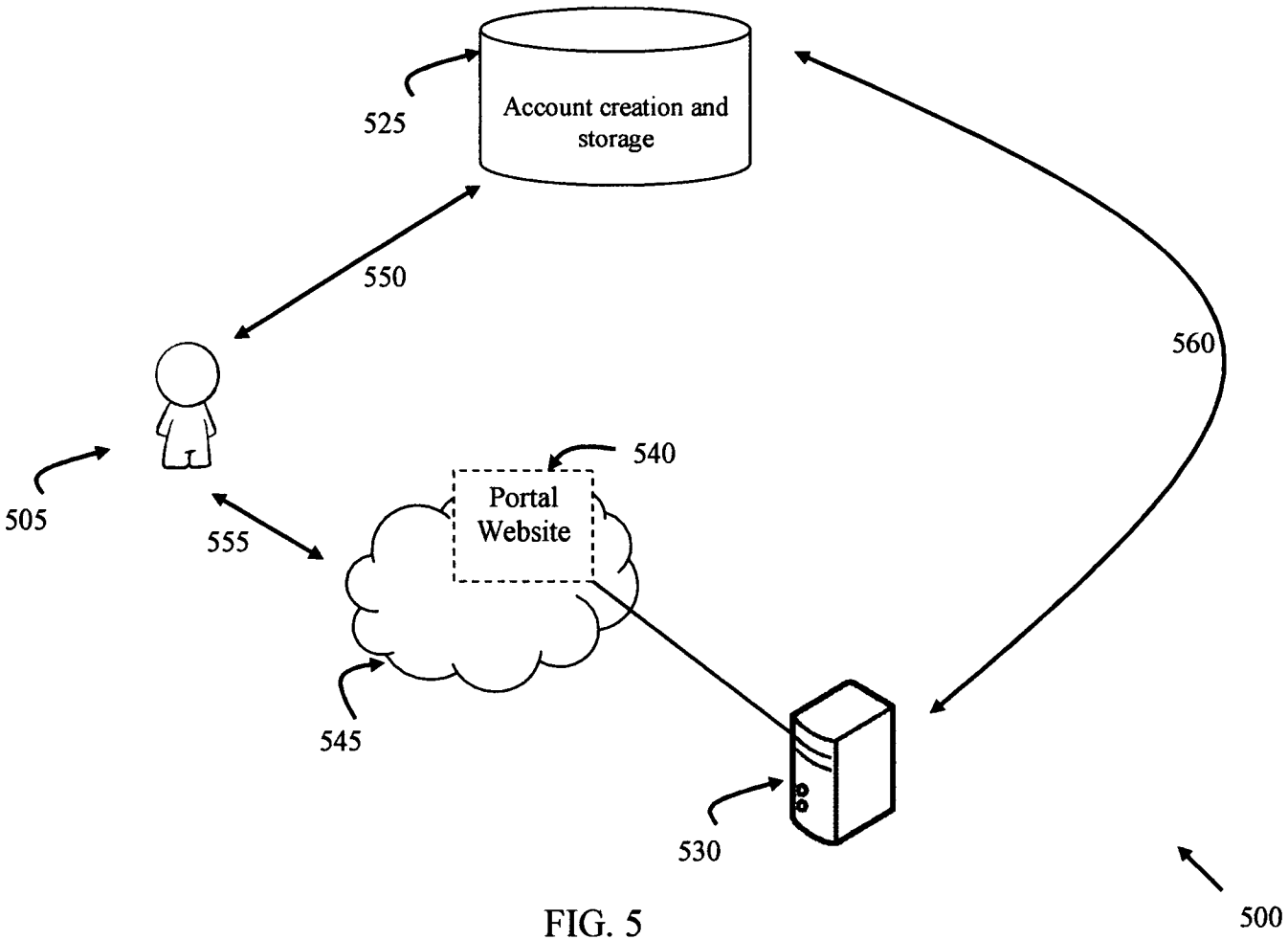
FIG. 5 is a schematic diagram of the use of the portable device deployed in a more general central depository for multiple service providers of online services.

Use of USB Access Keys may be managed by a central repository. The advantage of using a central repository is that it can act as an aggregator of identities for multiple service providers whom may not be in a position to individually deploy their own system. FIG. 5 schematically illustrates such a system 500 which utilises a central repository to enable management of USB Access Keys.

Any person 505 wishing to obtain a USB Access Key will be required to register/enrol with a central database 525, step 550. The procedure which the person 505 is required to go through to enable enrolment is identical to that described with reference to FIG. 2. Once enrolled, the person is able to access any number of service providers whom have subscribed to the central registry 525.

When an enrolled person wants to access to gaming, that person 505 will log onto a particular service provider's website 540, step 555. The information which the person 505 enters into the website is then transmitted from the website's server 530 to the central database 525 step 560, for checking against records stored in the central database 525 to confirm that the person presenting themselves for gaming is the legitimate owner of the USB key. Once ownership of the USB Access Key is confirmed, the person's credentials are passed to the service provider 530 who is then able to confidently conduct transactions with the person 505 over the network 545. The person may conduct multiple transactions with the service provider in a single session, however for every new session, the person's identity and credentials will need to be checked.

It will be appreciated by persons skilled in the art that numerous variations and/or modifications may be made to the invention as shown in the specific embodiments without departing from the scope of the invention as broadly described. For instance, the portable device as depicted in FIG. 1, may comprise a data transceiver communicatively coupled to the processor and configured to enable the portable device 100 to transmit and receive data via the transmission and reception of electromagnetic waves. In one embodiment, the data transceiver comprises an infrared (IR) transceiver that can communicate with a number of commercially available peripherals with similar capability. This feature is particularly useful, because it provides the portable device 100 with another means for communicating with external peripherals and devices, even when the portable device 100 may already coupled to the I/O port of a host computer.

The biometric reader 110 in the above example takes the form of a fingerprint reader; in other embodiments, biometric reader 110 is a signature scanner, iris scanner, microphone for voice input, or other biometric sensing device.

Read write memory 150 was described above as a flash memory device. The flash memory device may be partitioned with each partition implemented as a physically/electronically separate device on the flash memory device. For instance partition is implemented on a different physical plane.

Each of the partitions may have associated an X decoder, and a Y selector. Each of the Y selectors may be coupled to a Y decoder that controls the Y selectors. The X decoders and Y selectors enable selection of a specific area within flash memory for access, including reading, writing, or erasing. Having multiple X selectors and Y decoders permits simultaneous access to more than one subsection of the flash memory. For example, while partition A may be erased, partition B may simultaneously be read, and partition C written to. Each of the partitions may include one or more blocks, that may be erased separately. Thus, for example, a memory in partition A may be written to, while a memory block in partition B is being erased. In such an example a user interface would be provided to permit a user to control the access to the flash memory. The present embodiments are, therefore, to be considered in all respects as illustrative and not restrictive.

FIG. 5 schematically illustrates the use of the portable device which is deployed in a more general central depository for multiple service providers of online services. A person 505 wishing to gain access to internet based services generally, is required to undergo an enrolment procedure and register their personal details with a central database register 525. This procedure is similar to that outlined with respect to FIG. 2. To enable registration, the person confirms their identity, stores their biometrics in an account creation and storage database 225 and assuming the person passes all identity checks, the person receives a biometric USB key.

Sometime later, that person 505, using their biometric USB key, logs onto a service provider's website 540 via a communications network 545 such as the internet. The service provider's website 540 then communicates with an external network 530 which is responsible for confirming that the current user 505 is the legitimate owner of the biometric USB key and for confirming the identity of that user. The external network 530 retrieves information from the central database register 525. Assuming ownership is confirmed, the person's 5050 credentials are retrieved from the central database register 525 and passed onto the service provider who then conducts a transaction with the person 505 over the network 545 with full confidence in the person's bona fides.

It should be appreciated that the person 505 may conduct multiple transactions with the service provider in one session. However for every new session, the person's 505 identity and credentials will be checked by the external network 530. In effect, the external network 530 serves as a central repository and aggregator of identities for multiple service providers who could not afford to individually deploy such a system.

The claims defining the invention are as follows:

1. A portable device to enable access to and regulate gambling, the portable device comprising:

a universal serial bus (USB) connector configured to operatively couple with an input/output port of a remote device;

a biometric reader configured to validate a biometric authentication input of a user based on a stored authentication value;

a memory component;

a processor, in communication with the memory component, the biometric reader and the USB connector, the processor operable when the authentication input validates successfully to:

execute code to determine whether the user is prohibited from gambling; and when the user is not prohibited from gambling to:

execute code to enable access to gambling via an interface of the remote device, to compare real-time gambling behaviour of the user against a stored profile for the user; and to prevent the user from any further access to gambling via the or any other interface should the gambling behaviour of the player exceed that specified by the user's stored profile.

2. The portable device according to claim 1 where the USB connector is configured to operatively couple directly with the input/output port of the remote device.

3. The portable device according to claim 1 where the authentication value is stored remotely from the portable device.

4. The portable device according to claim 1 where the authentication value is stored to memory in the device's memory component.

5. The portable device according to claim 1 where the input/output port of the remote device is a USB port of a gambling machine.

6. The portable device according to claim 1 where the input/output port of the remote device is a USB port of one of a computer, cell phone, smart phone, personal organizer and television which is connectable to a host server to enable access to gambling.

7. The portable device according to claim 1 where the user's stored profile includes at least one of a maximum allowable loss within a specified period of play and a maximum amount wagered within a specified period of play.

8. The portable device according to claim 7 where the specified period of play is defined as a substantially continuous period of play.

9. The portable device according to claim 7 where the user's profile is stored remote from the portable device.

10. The portable device according to claim 7 where the user's profile is stored to memory in the device's memory component.

11. The portable device according to claim 7 where the gambling behaviour of the user includes one or more of gambling wagers, an amount won, an amount lost, a number of games played and a period of play for each bet wagered.

12. The portable device according to claim 1 further comprising an electronic purse to receive funds to enable the user to undertake a gambling activity.

13. The portable device according to claim 1 where digital certificates are stored to the memory component and the processor is further operable to encrypt data transferred via the USB connector.

14. The portable device according to claim 6, where the host server to which the computer, cell phone, smart phone, personal organizer or television connects is a master portal through which the player can gain access to multiple service providers of gambling.

15. A method to enable access to and to regulate gambling, the method comprising:

operatively coupling a USB connector of a portable device with a remote device having an interface via which a user accesses gambling;

validating a biometric authentication input of a user based on a stored authentication value, and when the authentication input validates successfully then determining whether the user is prohibited from gambling, and only when the user is determined not to be prohibited from gambling enabling access to gambling via the interface of the remote device;

comparing real-time gambling behaviour of the user against a stored profile for the user; and preventing further gambling to the user via the interface should the gambling behaviour of the player exceed that specified by the user's stored profile.

16. A system to enable access to and to regulate on-line gambling, the system comprising:

a gambling server operable under program control to facilitate regulation of on-line gambling, the gambling server in communication with one or more external servers each associated with an accredited gaming facility;

a master portal communicable with the gaming server by means of a communication network and further communicable with one or more remote computing devices on which registered users are able to access at least some of the accredited gaming facilities in order to gamble, wherein said remote computing devices are operable to communicate with a biometric enabled portable device to enable a registered user of said biometric enabled portable device to access gambling; and a database server in communication with the gambling server, the database server storing gambling behaviour information associated with registered users;

wherein on receiving notification of a valid biometric authentication input, a registered user is granted access to a selected external server which is associated with an accredited gaming facility, and said selected external server is operable to transmit data indicative of a summary of said registered user's gambling behaviour to at least one of said database server and to a memory of said biometric enabled portable device of said registered user.

17. A system according to claim 16, wherein the biometric enabled portable device comprises:

a universal serial bus (USB) connector configured to operatively couple with an input/output port of a remote device;

a biometric reader configured to validate a biometric authentication input of a registered user based on a stored authentication value;

a memory component;

a processor, in communication with the memory component, the biometric reader and the USB connector, the processor operable when the authentication input validates successfully to: execute code to determine whether the registered user is prohibited from gambling; and when the user is not prohibited from gambling to: execute code to enable access to gambling via an interface of the remote device, to compare real-time gambling behaviour of the user against a stored profile for the registered user; and to prevent the registered user from any further access to gambling via the or any other interface should the gambling behaviour of the player exceed that specified by the registered user's stored profile.

18. A system as claimed in claim 16 in which the communication network is the Internet.

19. A system as claimed in claim 17 wherein one or more of the remote computing devices is a mobile phone.

* * * * *